US005992621A

United States Patent [19]

Grant et al.

[11] Patent Number: 5,992,621

[45] Date of Patent: Nov. 30, 1999

[54] CIGARETTE PACKAGE CAPABLE OF EXTINGUISHING AND STORING CIGARETTE BUTTS

[76] Inventors: Donald F. Grant, 2258 Cotter's Crescent, Gloucester, Ontario, Canada, K1V 8Y6; Earl P. Hoeg, Apt.405, 500 Laurier Ave. W., Ottawa, Ontario, Canada, K1R 5E1; Francis H. Stoyles, 25 Paula Crescent, Nepean, Ontario, Canada, K2H 8Y8

[21] Appl. No.: 09/066,558

[22] Filed: Apr. 28, 1998

[30] Foreign Application Priority Data

Apr. 29, 1997 [CA] Canada ..... 2203977

[51] Int. Cl.[6] ..... A24F 15/00

[52] U.S. Cl. ..... 206/246; 206/257; 206/264; 206/273

[58] Field of Search ..... 206/246, 256, 206/257, 258, 259, 261, 264, 268, 273

[56] References Cited

U.S. PATENT DOCUMENTS

| | | | |
|---|---|---|---|
| 372,119 | 10/1887 | Cohn | 206/257 |
| 1,253,219 | 1/1918 | Dula | 206/257 |
| 1,684,381 | 9/1928 | Bahr | 206/257 |
| 2,606,562 | 8/1952 | Siegel . | |
| 2,619,092 | 11/1952 | Ayers . | |
| 3,096,878 | 7/1963 | Whitley et al. . | |
| 3,159,272 | 12/1964 | Swift | 206/246 |
| 4,207,976 | 6/1980 | Herman . | |
| 4,577,758 | 3/1986 | Gilda et al. | 206/496 |
| 4,961,496 | 10/1990 | Focke et al. . | |
| 4,984,586 | 1/1991 | Nae-Won . | |
| 5,575,385 | 11/1996 | Zona | 206/256 |

*Primary Examiner*—B. Dayoan
*Assistant Examiner*—Nhan T. Lam
*Attorney, Agent, or Firm*—Jones, Tullar & Cooper, PC

[57] ABSTRACT

A cigarette package comprising an outer container, and, within the container, a series of parallel elongated compartments each having dimensions suitable for holding only a single cigarette, the compartments each having walls formed by one or more pieces of non-combustible sheet material, such as metal foil. The compartments are such as to allow a cigarette to be removed from one end of a compartment and the butt of a smoked cigarette to be inserted into the same end of the compartment, the compartments being sufficiently narrow that a lighted butt or cigarette inserted into one of the compartments becomes extinguished.

14 Claims, 4 Drawing Sheets

CIGARETTE PACKAGE CAPABLE OF EXTINGUISHING AND STORING CIGARETTE BUTTS

BACKGROUND OF THE INVENTION

1. Field of the Invention

The present invention relates to a cigarette package which can be used both for extinguishing lighted cigarettes or butts, and for disposing of such butts.

2. Prior Art

Cigarettes are usually disposed of either in ashtrays or outdoors on the ground, or sometimes in lakes or streams, with results which are unsatisfactory both aesthetically and environmentally. Outdoors, the butts not only create a litter problem, but sometimes cause forest fires. Indoors, the discarded butts are unsightly and, when not properly extinguished, give off fumes. Ashtrays containing smoldering cigarettes are sometimes emptied into waste containers with resulting fires.

Proposals have been made in the past for portable ashtrays, and for portable devices, referred to as "snuffers", which can be used to extinguish burning cigarettes. In some cases the snuffer is combined with a cigarette case. Also, some cigarette packages or cases have been designed with ashtrays or means for holding used cigarette butts. Packages or cases having such constructions are shown in the following patents:

U.S. Pat. No. 2,606,562, issued Aug. 12, 1952 to Siegel;

U.S. Pat. No. 3,096,878, issued Jul. 9, 1963 to Whitely et al.;

U.S. Pat. No. 4,207,976, issued Jun. 17, 1980 to Herman; and

U.S. Pat. No. 4,961,496, issued Oct. 9, 1990 to Focke et al.

The Siegel and Herman patents show cigarette cases which are of relatively expensive, molded plastic construction, seemingly not intended to be disposable. The Siegel case will extinguish burning cigarette butts, but will not store them. The Herman case will both extinguish and store the butts; the case with the used butts is intended to be returned to the retailer for replacement with a new, filled case. This obviously poses special marketing requirements.

The Whitley et al patent shows a disposable cigarette package which has a portion acting as an ashtray, but this construction will not store the cigarette butt.

The Focke et al patent shows a disposable package of generally conventional paperboard construction, in which a partition is provided between the space having unused cigarettes and another space which can receive the used butts. It is stated that this partition can be made of flame resistant material, such as aluminum foil, which allows for inserting butts which have not been completely extinguished. However, it would seem that a burning cigarette butt when inserted would likely contact other butts already present and cause additional combustion.

Accordingly, none of these patents provides a low cost, disposable cigarette package which is capable of receiving burning cigarette butts, extinguishing them, and also storing them until the package is finished and is disposed of.

SUMMARY OF THE INVENTION

According to the present invention, there is provided a cigarette package having an outer container, usually a paperboard carton, within which is a series of parallel elongated compartments each having dimensions suitable for holding only a single cigarette, the compartments each having a wall or walls formed by one or more pieces of non-combustible sheet material. The compartments are such as to allow a cigarette to be removed from one end of the compartment and the butt of a smoked cigarette to be inserted into the same end of the compartment, the compartments being sufficiently narrow that a lighted butt or cigarette inserted into one of the compartments becomes extinguished.

The compartments surround the cigarettes fairly closely, so that the cigarette takes up the majority of the cross-sectional space of each compartment, and so that a burning butt inserted into the compartment is deprived of oxygen and extinguished. The non-combustible sheet material prevents contact between the burning butt and any other combustible matter including other butts and unsmoked cigarettes. Preferably, the sheet material includes a metal foil, such as an aluminum foil, but other non-combustible sheets may be used. Parts of the sheet material may be glued or other wise fastened together to ensure structural integrity and immediate extinguishment.

In one construction, a piece of the sheet material may completely surround each cigarette.

In another construction, the pieces of sheet material include are of two configurations, namely a first, corrugated sheet with bottoms of the troughs forming a front or a rear wall of each compartment and also forming dividers or side walls between the compartments, and a further sheet of a second configuration which is non-corrugated and which forms walls of the compartments opposite to the front or rear walls formed by the corrugated sheet. The further sheet may also form a bottom closure of the compartments, and may enclose the sides of the corrugated sheet.

In a preferred arrangement, the first corrugated sheet forms the rear walls and side walls of one row of compartments, a second corrugated sheet forms front walls of the same compartments and also forms rear walls and sidewalls of a second row of compartments, and the further sheet has a flat portion forming the front walls of the compartments of the second row. This further sheet is also bent in at the sides and bottom so as to enclose the side walls of the compartments at each side of the assembly, and also provides a bottom for all the compartments. This pattern may be repeated depending on the desired number of rows of cigarettes. These non-combustible sheets may be glued or otherwise held together to reduce the risk of damage to the assembly, and the possibility of slow extinction of cigarettes. The invention also includes this assembly itself, suitable for insertion into a regular, rectangular carton.

BRIEF DESCRIPTION OF THE DRAWINGS

Preferred embodiments of the invention will now be described by way of example with reference to the accompanying drawings, in which.

DETAILED DESCRIPTION

Figure 1:
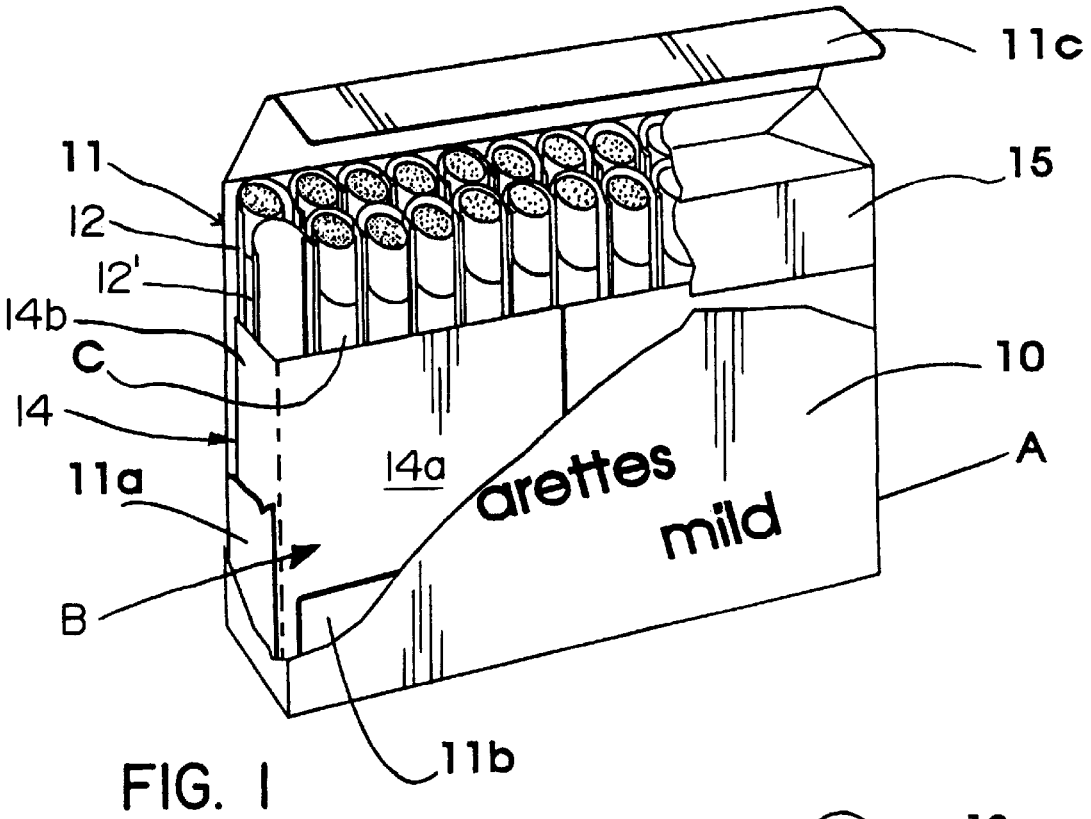
FIG. 1 is a perspective view of a cigarette package in accordance with the invention, open and partly broken away to show the construction.

FIG. 1 shows the complete package in accordance with a preferred embodiment of the invention, holding cigarettes C, and which comprises:

a) An outer container A which is in the form of a conventional disposable paperboard carton comprising an outer, rectangular, open-ended sleeve 10, and, within this, a slidable paperboard tray 11 having sides 11*a*, a folded in bottom portion with an inner flap which is shown at 11*b*, and a hinged lid 11*c*. This outer container can be exactly of the form usually used for selling cigarettes, and may have the same dimensions as that of a standard package for 20 or 25 cigarettes.

b) Two inner assemblies or inserts B one of which holds 12 cigarettes, and the other of which holds 13 cigarettes. Each assembly comprises three pieces of non-combustible sheet material, notably two corrugated sheets 12 and 12', and a front sheet 14 having a flat front portion 14*a* and bent in sides 14*b*. One such assembly is further described below with reference to FIGS. 2, 3*a* and 3*b*.

c) A pair of top covers 15 which enclose the upper ends of the cigarettes and which are disposed of when the cigarettes are to be removed from that portion of the package.

Figure 2:
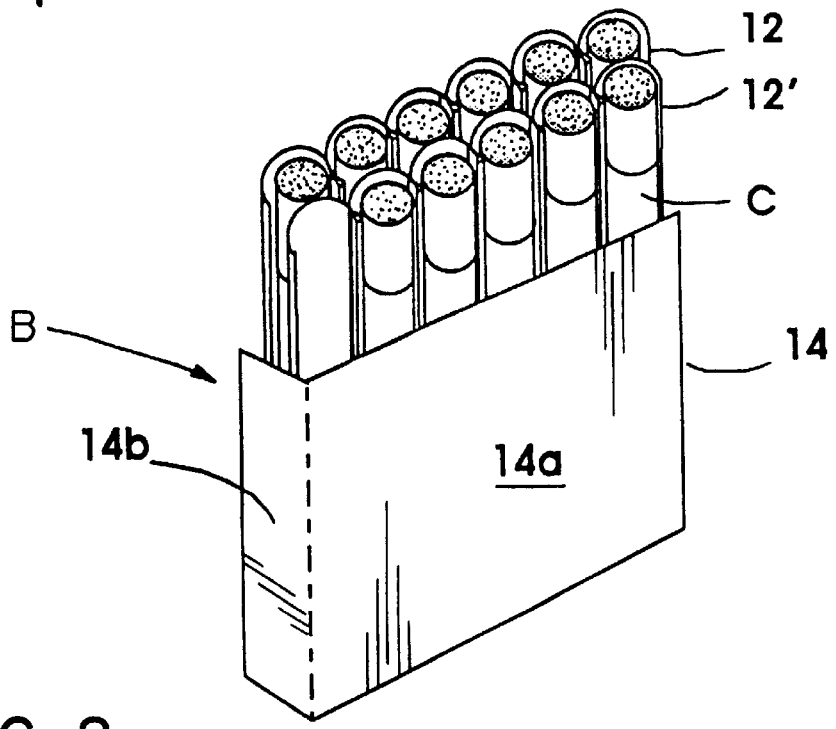
FIG. 2 is a perspective view of some novel components of the package of FIG. 1, removed from the outer cardboard container, and showing cigarettes in place.

FIG. 2 shows one of the assemblies or inserts B of non-combustible material, for enclosing 12 cigarettes, in accordance with the invention. Pieces 12 and 14 of this assembly are shown separately in FIGS. 3*a* and 3*b*, the latter figure showing the inner side of piece 14.

Figure 3A:
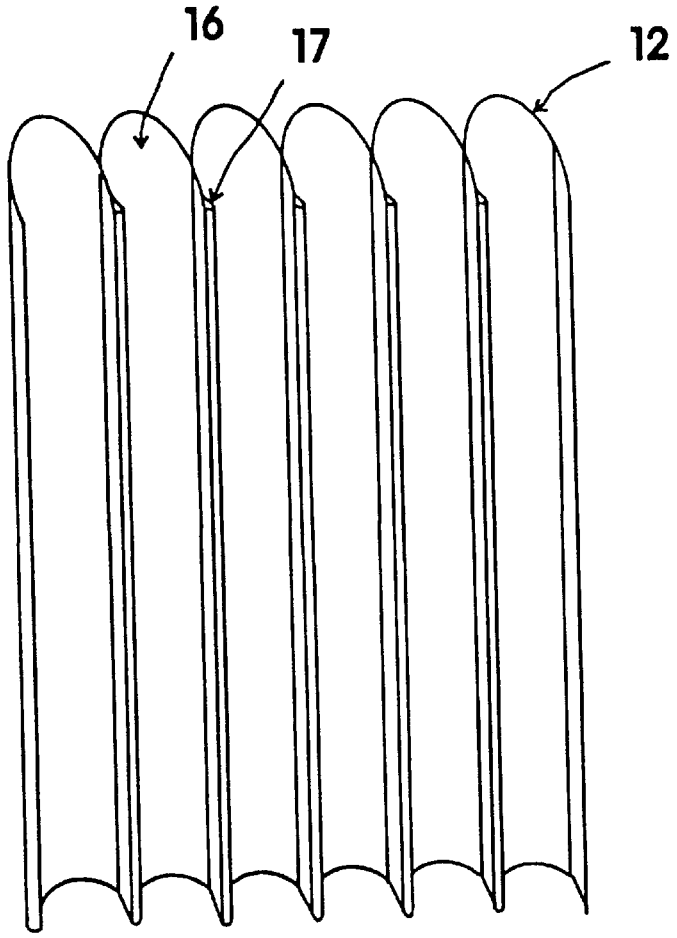
FIGS. 3*a* and 3*b* show perspective views of the individual components used in the assembly of FIG. 2.
Figure 3B:
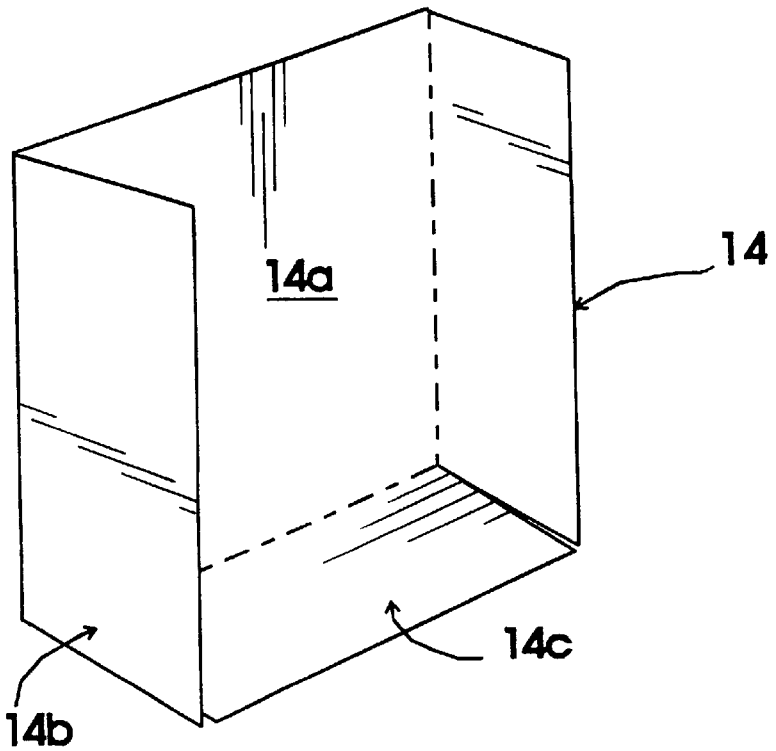

FIG. 3*a* shows one corrugated piece 12, which, like piece 12', is formed from a sheet of aluminum foil having a thickness of about 0.002 inches, which has been deformed into a series of troughs 16 of generally U-shaped cross-section, joined by folds 17 of small radius. The sheet is shaped so that the rear, upper ends of the troughs are higher than the front ends, defined by the folds 17. The front sheet 14 is formed of thicker aluminum foil, of about 0.006 inches thickness. It has a main flat part 14*a* which provides a front closure at the open sides of the troughs of the front corrugated piece 12', bent in sides 14*b* which enclose the sides of both the corrugated sheets 12 and 12', and a bent in bottom 14*c* which closes the bottoms of the all the troughs.

It will be seen from FIGS. 1 and 2 that when the pieces 12, 12', and 14 are fitted into the outer container A, they form an assembly or insert which, along with the second assembly formed of similar parts and which has 13 compartments, provides an elongated compartment for each of the 25 cigarettes C. The rear row of compartments of each assembly has side and rear major walls formed by the troughs of sheet 12 and the rear sides of the troughs of sheet 12'. The front row has side and rear walls formed by the troughs of sheet 12' and front walls by the sheet portion 14*a*. The widths of the troughs are only a little wider than the diameter of the cigarettes, say less than 30% wider, and the cross-sectional area of each of the front compartments formed between sheet 12' and sheet portion 14*a* is preferably no more than about 50% greater than the cross-sectional area of each cigarette. These proportions are found to result in a burning butt being extinguished rapidly when inserted into any of the empty compartments. Such a butt never comes into contact with any combustible material. The rear compartments are also narrow enough to act in much the same way.

The sloped arrangement of the troughs, with the front lower than the back, enables cigarettes to be easily removed, and also acts to guide the returned butts into the compartments. Also, when a butt has been inserted into a compartment, the upwardly projecting rear portion of the trough may be shaped so that it can be bent down to close the compartment. This not only helps to extinguish the butt, but also prevents the butt or ash from falling out of the compartment if the package becomes inverted.

The assembly shown in FIG. 2 can be held together by adhesive so as to form a self-supporting structure ready for insertion into the container A.

Figure 4:
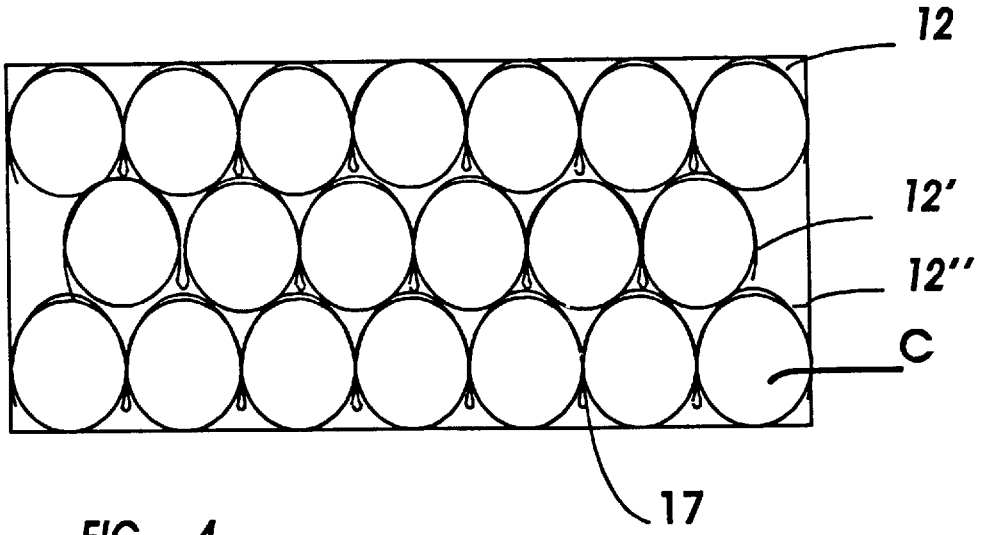
FIG. 4 is a plan view of a variation of the FIG. 2 arrangement, designed for 20 cigarettes.

FIG. 4 shows an embodiment similar to that described, except that three sheets 12, 12' and 12" of corrugated foil are used, giving enough capacity for 20 cigarettes. Also, here it may be noted that the corrugated sheets are staggered with respect to adjacent sheets, so that the fold line 17 of each of the two rear sheets 12 and 12' comes into contact, or near contact, with the rear of the trough in front. This staggered arrangement gives more fully enclosed compartments than the arrangement of FIGS. 1 and 2. This embodiment is adaptable to any number of rows with appropriate number of cigarettes.

Figure 5:
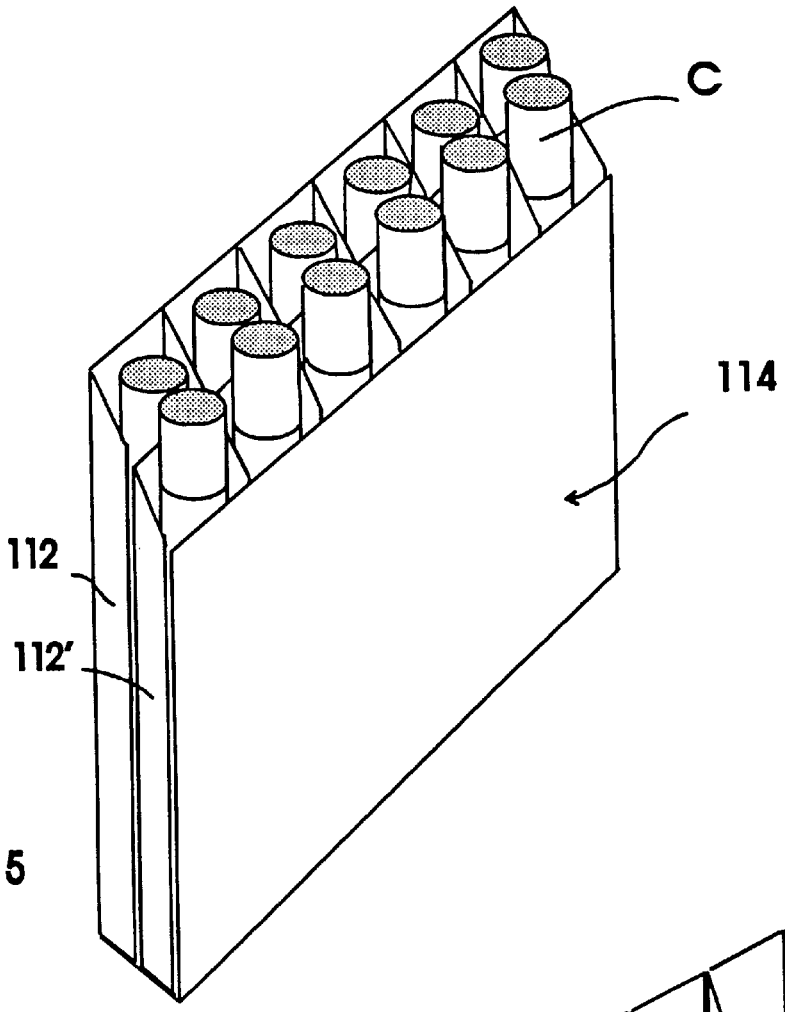
FIG. 5 is a perspective view, similar to that of FIG. 2, of an alternative form of novel components used in accordance with the invention.
Figure 6:
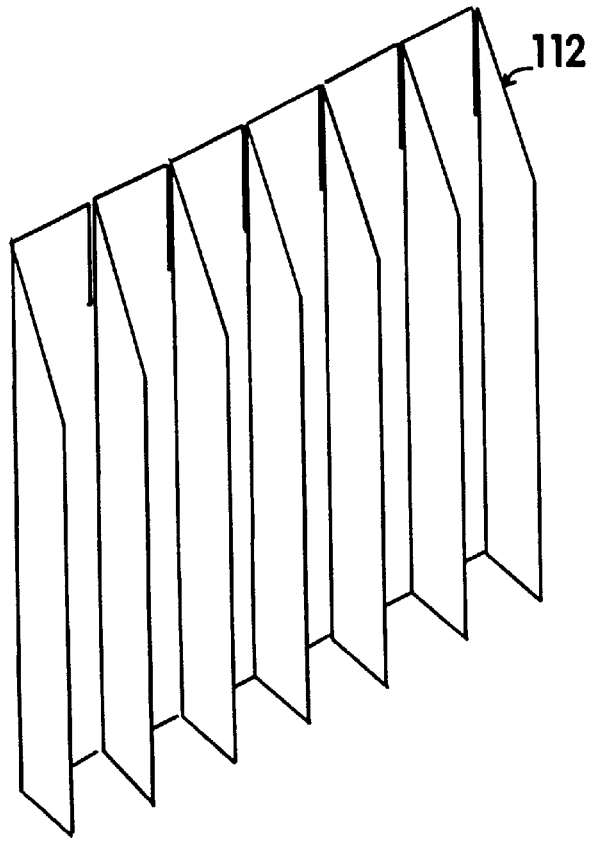
FIG. 6 is a perspective view of one of the components shown in FIG. 5.

FIGS. 5 and 6 show an insert which is generally similar to that of FIGS. 2 and 3, except that the corrugated sheets 112 and 112' are formed into troughs of generally square cross-section. In this case, with the troughs aligned (i.e.non-staggered), the troughs of the rear sheet 112 are completely closed by the rear surfaces of the front corrugated sheet 112'. A sheet 114, similar to sheet 14 forms the front of the enclosure for the front row of compartments, and the bottom of the enclosure for both rows of compartments.

Figure 7:
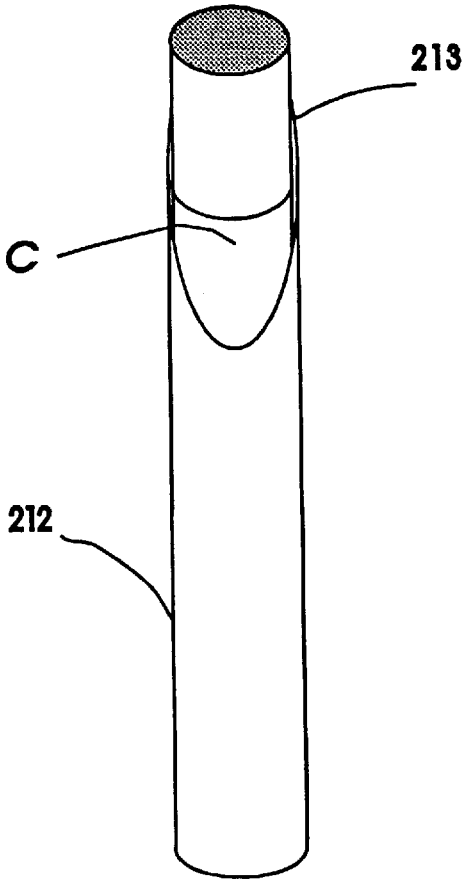
FIG. 7, which appears on the same drawing sheet as FIG. 4, shows components of yet another embodiment of the invention.

FIG. 7 shows a further embodiment of the invention. Here, each cigarette compartment has walls formed by a cylindrical tube 212 of non-combustible sheet material, such as aluminum foil, having a cut-away, slanted upper end 213 which allows easy removal of its cigarette C and insertion of a butt. In the practice of this embodiment, tubes 212 are fitted close together in one or more rows in a cigarette carton and held in place by adhesive, and their lower ends are closed by further foil or non-combustible material. Each tube is sufficiently narrow to provide a compartment capable of extinguishing and storing a cigarette butt.

To provide additional protection against combustion, or as an alternative to sheets 14 or 114, a non-combustible material, in the form of a coating or lining, may be provided on the inside of the paperboard carton. In this case, one of the "pieces of non-combustible sheet material" will be the carton wall itself.

We claim:

1. A cigarette package comprising an outer paperboard container, and, within said container, a series of parallel elongated compartments each having dimensions suitable for holding only a single cigarette, said compartments each having walls formed by non-combustible sheet material, including:

a) a first corrugated sheet of said sheet material providing a series of troughs each forming a major wall of each compartment and dividers or side walls between the compartments which prevent contact between cigarettes or butts in adjacent compartments, and b) a further piece of said sheet material which is non-corrugated forming walls of the compartments opposite to said major walls and a bent in lower portion forming a bottom closure for said compartments;

said compartments being such as to allow a cigarette to be removed from one end of a compartment and the butt of a smoked cigarette to be inserted into the same end of the compartment, the compartments being sufficiently narrow that a lighted butt or cigarette inserted into one of the compartments becomes extinguished.

2. A cigarette package according to claim 1, further comprising non-combustible material on the inside of the outer paperboard container.

3. A cigarette package according to claim 1, wherein said further piece of non-combustible material comprises a wall of the outer container having a coating or a lining of non-combustible material.

4. A cigarette package according to claim 1, wherein part of the corrugated sheet material forming each compartment extends above the sidewalls of the compartment and can be bent over to retain a cigarette butt in the compartment.

5. A cigarette package according to claim 1, wherein said sheet material includes a metal foil.

6. A cigarette package according to claim 5, having 20 cigarettes, and which has the dimensions of a standard package of 20 cigarettes.

7. A cigarette package according to claim 5, having 25 cigarettes, and which has the dimensions of a standard package of 25 cigarettes.

8. An assembly for use in an outer paperboard container of a cigarette package, which assembly forms a series of parallel elongated compartments each having dimensions suitable for receiving only a single cigarette, wherein said compartments each have walls formed by:

a) a first corrugated sheet of non-combustible sheet material providing a series of troughs each forming a major wall of each compartment and dividers or side walls between the compartments which prevent contact between cigarettes or butts in adjacent compartments, and b) a further piece of non-combustible sheet material which is non-corrugated and which forms a wall of each compartment opposite to said major wall, and also provides a bent in lower portion forming a bottom closure for said compartments, said compartments being such as to allow removal of a cigarette from one end of a compartment and to allow the butt of a smoked cigarette to be inserted into the same end of that compartment, said compartments each being sufficiently narrow that a lighted butt or cigarette is extinguished when inserted into a compartment.

9. An assembly according to claim 8, wherein said first corrugated sheet forms the rear major walls and side walls of one row of compartments, and a second corrugated sheet forms the front major walls of the same compartments and also forms the rear walls and side walls of a second row of compartments, and the further sheet has a flat portion forming the front walls of the compartments of the second row.

10. An assembly for a cigarette package according to claim 8, wherein the sheet material includes a metal foil.

11. An assembly according to claim 8, wherein part of the corrugated sheet material forming each compartment extends above the sidewalls of the compartment and can be bent over to retain a cigarette butt in the compartment.

12. An assembly according to claim 8, wherein said first corrugated sheet forms the rear major walls and side walls of one row of compartments, a second corrugated sheet forms the front major walls of the same compartments and also forms the rear major walls and side walls of a second row of compartments, a third corrugated sheet forms the front major walls of the compartments of the second row and rear major and side walls of a third row of compartments, and wherein the further sheet has a flat portion forming the front major walls of the compartments of the third row.

13. An insert assembly according to claim 8, wherein the first corrugated sheet and the non-corrugated sheet are held together so as to form a self-supporting structure suitable for insertion into a paperboard container.

14. An assembly for use in an outer paperboard container of a cigarette package, which assembly forms a series of parallel elongated compartments each having dimensions suitable for receiving only a single cigarette, wherein said compartments each have walls formed by:

a) a first corrugated sheet of non-combustible sheet material providing a series of troughs each forming a major wall of each compartment and dividers or side walls between the compartments which prevent contact between cigarettes or butts in adjacent compartments, and b) a further piece of non-combustible sheet material which is non-corrugated and which forms a wall of each compartment opposite to said major walls and having bent in sides enclosing the sides of said first corrugated piece, and a bent in lower portion forming a bottom closure for said compartments, said compartments being such as to allow removal of a cigarette from one end of a compartment and to allow the butt of a smoked cigarette to be inserted into the same end of that compartment, said compartments each being sufficiently narrow that a lighted butt or cigarette is extinguished when inserted into a compartment.

* * * * *